United States Patent [19]

Goddard

[11] Patent Number: 4,511,824

[45] Date of Patent: Apr. 16, 1985

[54] PARALLEL ACCESS MEMORY LIGHTING SYSTEM

[76] Inventor: Robert M. Goddard, 330 First Ave., New York, N.Y. 10009

[21] Appl. No.: 514,305

[22] Filed: Jul. 15, 1983

[51] Int. Cl.[3] ..... G05F 1/00; H05B 37/02

[52] U.S. Cl. ..... 315/297; 315/292; 315/315; 315/316; 364/480

[58] Field of Search ..... 315/297, 292, 316, 315, 315/317; 364/480, 400

[56] References Cited

U.S. PATENT DOCUMENTS 3,579,030 5/1971 Bentham ..... 315/315

3,763,394 10/1973 Blanchard ..... 315/316

4,158,132 6/1979 O'Dell ..... 315/292

4,358,715 11/1982 Dinges et al. ..... 315/292

OTHER PUBLICATIONS

Metrix M-2: Keyboard Software.

*Primary Examiner*—Harold Dixon

*Attorney, Agent, or Firm*—Kenyon & Kenyon

[57] ABSTRACT

The disclosure relates to an electronic dimmer with specific computer control especially for theatrical productions with an emphasis upon improved electronic processing especially a parallel access memory.

17 Claims, 11 Drawing Figures

PARALLEL ACCESS MEMORY LIGHTING SYSTEM

BACKGROUND OF THE INVENTION

This application relates to performance lighting in general and, more specifically, to an improved electronic method by which simultaneous access may be provided to a large number of presets stored in electronic memory.

The transition from the storage of lighting preset intensity data by mechanical means (e.g. U.S. Pat. No. 3,049,645) to their electronic storage in digitally-coded form was a major evolutionary development in lighting control, for it removed most practical limits on both the number of presets stored and the number of channels which could be controlled. Electronic storage of level data was also a prerequisite to the modern memory console, whose processor-based, serial/computational approach to manipulating intensity data allowed the automation of complex cue sequences at a lower hardware cost than the parallel/analog approach of the first experimental memory systems would have allowed.

The modern, software-based, CRT-oriented memory console as described in U.S. Pat. No. 3,898,643 has been universally adopted by those performances that can afford them. Such consoles generally limit the number of presets simultaneously available to the operator (generally to four presets). This limitation is of little or no consequence to the linear, cue-to-cue sequencing which has been used to light performances such as theatrical performances for generations. There are, however, a large number of other production types not organized enough, predictable enough, or well-enough rehearsed for cue-to-cue operation to be practical. Instead, such productions require simple and simultaneous access to a large number of presets (twenty-four or more) preferably by means of an equal number of linear potentiometers serving as preset masters. Traditional memory consoles and the serial/computational approach they employ have proven ill-suited to providing this capability.

Unrehearsed productions (or unpredictable developments in otherwise predictable ones) require quick response by the lighting console operator with the appropriate preset. Traditional memory consoles require that the operator determine the identifying number of the appropriate preset and enter it using the console's keyboard protocol before it can be made available on a fader. In contrast, a "parallel access" capability provides a large number of presets instantly available via their associated master faders; faders which can be clearly labelled by the operator with alphanumeric descriptions of their contents written on tape strips, further reducing response time.

A parallel access capability also permits the operator to use an "elements" operating strategy instead of, or in addition to, the traditional "cue-to-cue". That is, the operator may use his preset capacity to record the basic elements of stage pictures (such as color washes), each in a different preset, rather than recording the complete stage pictures themselves. These "elements" may be combined by the operator in modular fashion and in real time to produce a very large number of more complex stage pictures. In contrast, the traditional memory console's limits on the number of presets simultaneously available requires that its operator record every possible stage picture he might need, each as a separate preset and under a different identifying number (with the limits on access time described).

For these reasons, a parallel access capability and the elements strategy it allows represents a simpler, more flexible, more user-friendly, and far more economical approach to memory (both in preset number and recording time) than traditional memory consoles for many productions.

One such application requiring parallel access capability is concert lighting. Despite the availability of modern memory consoles at similar or lower cost, this industry's need for parallel access is such that it has spent more than $3,000,000 on specialized consoles providing the capability.

Because a suitable electronic parallel access memory means has not been available, the industry has been forced to rely on diode pin matrices (non-level setting versions of the device described in U.S. Pat. No. 3,049,645). Such pin matrices ran into practical limitations of physical size and cost (at about 4000 crosspoints) long before providing sufficient preset capacity. Since 1978 efforts have been directed towards developing a parallel access memory system combining the electronic channel intensity storage and keyboard, display, and data carrier functions of traditional memory consoles with the parallel access capability afforded by pin matrix units. Although several electronic memory units suitable for chase sequences have been developed, none yet satisfies all the requirements for a parallel access system suitable to the needs of this industry. Therefore, virtually all consoles being sold and used in this industry today still incorporate pin matrices and suffer from their limitations.

Parallel access capability is also proving more useful than traditional memory consoles to many auditoriums and television studios.

General-purpose auditoriums frequently host events with little or no rehearsal and minimal technical staff—factors which severely limit the usefulness of a cue-to-cue strategy and, as such, traditional memory consoles. Television studios require preset storage at level, but seldom use most of the traditional memory console's more complex features (e.g. timed fades). On the other hand, many productions in both types of venue would make better use of parallel access to presets and the elements strategy, which traditional memory consoles do not allow.

As a result, the demand for parallel access memory has lead all of the major dimming equipment manufacturers to develop consoles purportedly providing it. But the serial/computational technique generally employed by such consoles overloads the processors on which such units are based, requiring multiple processors (sometimes distributed as far away as the dimmer racks), and/or imposing severe limits on the number of channels or presets available and/or requiring the omission of essential features (such as the ability to assign a channel to more than one simultaneously available preset or the ability to display the recorded channel intensity data).

All multi-scene lighting controllers of any type must perform three basic functions: memory, mastering and comparison.

First, a memory means must maintain the desired intensity value for each of the plurality of channels controlled, in each of the plurality of presets provided. This memory means may employ mechanical or electronic storage. In "manual" consoles as described in U.S. Pat. No. 3,946,273, this memory means comprises a linear potentiometer for each value. In the early theatrical memory console described in U.S. Pat. No. 3,049,645 and in most concert lighting consoles today, the memory means comprises a diode pin. In modern memory consoles as described in U.S. Pat. No. 3,898,643, electronic storage in digitally-coded form is employed.

Secondly, the lighting controller must master the channel intensity value in each preset. This mastering function requires multiplying the channel value as stored by the current condition of the appropriate preset master. In most manual consoles and a few memory consoles, this mastering function is performed in the analog domain by attenuation, variable-gain amplification, or pulse-width modulation. Most memory consoles and a few manual consoles master by multiplying the digitally-coded channel value by the digitized level of the preset master (whether a frontpanel hardware device or a software function such as a timed fader) to produce the channel level as mastered.

Thirdly, the lighting controller must compare the channel value as mastered for each preset in which the channel appears and output the highest value produced. In manual consoles operating in both the analog domain and in parallel, this comparison function ("highest takes precedence") may be accomplished readily by combining diodes. In lighting controllers, whether analog or digital, which operate in serial, the comparison function requires a short-term storage means retaining the channel's value as mastered in the previous preset so that it may be compared with the value for the next preset. The higher of the two is always retained, and after all of the mastering and comparison routines for a given channel are completed, the value remaining in the short-term storage means represents the channel's highest level as mastered, which may then be output.

Refer now to FIGS. 1A and 1B, where the operation of typical prior art memory controllers employing the serial/computational approach to the mastering and comparison operations is illustrated. FIG. 1A is a functional diagram showing the sequence of operations and their distribution between the processor, digital hardware, and analog hardware. FIG. 1B is a block diagram of a typical hardware design. Parts having the same function in both figures are identified with the same reference number.

Such controllers store digitally-encoded channel values in a semiconductor memory 102 (typically Random Access Memory devices). Processor(s) 101 operates in serial. Each second is divided into a number of refresh cycles, during which the level for each channel is calculated. Some portion of the refresh cycle is divided into a series of channel intervals equal to the number of channels allowed. Each such channel interval is further divided into a number of preset subintervals, the number of preset subintervals being equal to the number of presets simultaneously accessible. During each preset subinterval, processor 101 uses address bus 104 to cause memory 102 to output the desired channel value for that channel in that preset via data bus 103. That value is multiplied by the current value of that preset's master (whether a front-panel hardware device or a software function) to produce the channel value as mastered which is compared with the mastered value for the channel determined in the previous subinterval as described earlier.

Despite the absence of a CRT, most prior art parallel access memory controllers employ this same serial/computational approach. The only distinction between traditional memory consoles and parallel access memory controllers using this approach is the number of preset masters provided.

It is important to note that although such units employ a number of linear potentiometers as preset masters 110–117, they serve solely as an input device by which the operator indicates the desired level of the preset. They serve no electronic role in the mastering function and they do not carry signals. Such consoles merely sample the current condition of such preset master potentiometers 110–117 by supplying them with a constant DC voltage (illustrated as from power supply 108 via bus 109) and using a parallel/serial conversion (illustrated here as a plurality of address decoders 130–137 each recognizing a unique address on bus 139 as generated by processor 101 and closing an associated analog switch 120–127) so that the condition of each of the preset master potentiometers 110–117 may be detected on analog bus 129 for digitizing by A/D converter 107 and input to processor 101 via bus 106. This sampling of preset master potentiometers is a low priority activity for the processor and need take place no more than once per refresh cycle.

It is further important to note that in modern practice, and as illustrated in FIG. 1A, channel outputs are arrived at by purely computational means. Level data is not converted to analog or parallel form until the final level for the channel has been determined. Recently, the conversion of that final channel level to parallel form by converter 191 has been relocated from the console to the dimmer area to allow the connection 198 between the two to be reduced to a few wires. In many cases, the D/A converter 190 employed to convert the digitally-encoded channel values to an analog form compatible with analog dimmers 199A has been relocated to the dimmer area so that the portion of the serial link between the console and dimmers is digital in nature. Further, current trends towards a "digital dimmer" (similar to that disclosed in U.S. Pat. No. 4,241,295) would connect the dimmers 199D directly to the digital/serial output of processor 101 eliminating the use of analog voltages in the lighting controller's basic functions at any stage.

The total workload on the memory controller's processor(s) 101 is the computational load of determining the channel levels plus the considerable workload of maintaining a keyboard, display, and data carrier. The computational workload on the processor is $C \times P \times R \times Op$—where "C" equals the number of channels allowed; "P" equals the number of presets simultaneously available; "R" equals the refresh rate or number of times per second all channel levels must be recalculated to prevent a detectable delay in response; and Op equals the number of processor operations required for one mastering and comparison routine.

The most widely-used mid-level traditional memory console provides access to 120 channels via 4 presets (2 manual faders, 2 timed faders) with a refresh rate of 10 Hz (falling to 7 Hz with heavy workloads). The computational portion of the total processor workload is therefore $120 \times 4 \times 10 \times Op$ or 4800 mastering and comparison operations per second. A useful parallel access capability requires between 24 and 48 presets simultaneously available, resulting in an increase in the computational workload to 28,800–57,600 routines per second.

Further, some users have regarded 10 Hz. as too slow for concert lighting and proposed 15 Hz. as the minimum; resulting in a 50% increase in workload to 43,200–86,400 routines per second.

Therefore, despite its apparent simplicity, a useful parallel access capacity requires an increase in computational workload of as much as 18:1 relative to that of a traditional memory console—clearly beyond the capability of the processor in this or any other traditional memory console in common use.

To provide some semblance of parallel access capability, most prior art consoles either increase the available processor power and/or accept severe limitations on features and performance.

Processor power could be drastically increased by the use of a high-speed 16-bit processor with an associated co-processor or hardware multiplier. Such devices have only recently become available and their application would require a formidable development expenditure. Emphasis has therefore been placed on the use of the mature 8-bit processors already employed in existing lighting controllers. As the total workload required by a useful parallel access capability far exceeds the capacity of a single such processor, increasing processor power requires a multi-processor system.

Without careful design, multi-processor systems seldom produce a proportional increase in available power because of the communication required between processors and their contention for shared resources. A system's architecture must therefore maximize available power.

One such architecture is "horizontal". A "core" processor is used for all level computations, and its available power is maximized by shifting the burden of keyboard, display, data carrier, and output maintenance to additional processors. Because, however, all level computations are performed by the core processor, its power sets an absolute limit on the system's performance.

Another architecture is "vertical". One processor is provided for a modest number of channels (generally 24–32) and additional processors are added for each incremental increase in channel number. To reduce contention for resources and further modularity, each processor is provided with its own associated memory. While a vertical architecture lacks the inherent limitations of a horizontal architecture because it permits a parallel-processing approach to level computations, its design is more complex because multiple processors must communicate with a shared keyboard, display, and data carrier. Frequently another processor is added as a buffer and mediator between the channel processors and these resources. In some cases, all of the processors are contained within the console. However, at least two systems in current use employ a "digital dimmer" whose drive card serves as the processor for calculating the levels of the dimmers under its control as well as their firing angles. The console therefore becomes little more than a terminal and downloads both the condition of its preset master potentiometers and any channel values entered by the operator to the processors distributed through the dimmer enclosures via a complex bidirectional link.

Any multi-processor architecture suffers fron higher hardware costs and more complex software development than a single-processor system as well as the added difficulty of diagnosing and repairing interactive faults.

It is therefore highly desirable to provide parallel access capability using a single processor. However, because of the massive computational workload required by the serial/computational approach of most prior art parallel access controllers; single-processor controllers (and some multi-processor systems) require severe limits on one or more factors in the $C \times P \times R \times Op$ equation and/or the omission of essential features or peripherals.

Some consoles allow each channel to appear in only one of the available presets, reducing the "P" factor to 1, but virtually eliminating the usefulness of the controller. Another console allows access to 48 presets but allows only 48 channels.

Even with limitations on the number of presets available and/or the number of channels and/or a limited refresh rate, some units also require the sacrifice of essential peripherals such as a level display or data carrier. Of the five parallel access controllers currently in large-scale production, three do not allow the operator to display the contents of presets. Three of the five units are single-processor designs and none allows the use of a data carrier without the purchase of a second processor.

It has therefore become highly desirable to develop an electronic method of mastering and comparing channel values stored in electronic memory that is more appropriate to the massive workloads required by a useful parallel access capability than the processor-based serial/computational approach generally employed.

There is, therefore, a need to develop an electronic method of providing simultaneous access to large numbers of presets which effects a drastic reduction in processor workload relative to the serial/computational approach without the compromise of performance or features.

SUMMARY OF THE INVENTION

The parallel access memory controller of the present invention achieves this object through a specific combination of techniques having unique synergistic benefits in increasing system throughout.

All memory controllers must provide three basic functions (memory, mastering, and comparison) along with two support functions (internal data transfer and operator interface). The number of data transfer, mastering, and comparison operations required for a given number of channels and refresh rate is proportional to the number of presets simultaneously available. The fundamental advantage of the parallel access controller over traditional memory consoles; simultaneous access to large numbers of presets, may therefore also require an order-of-magnitude increase in system throughput. This inherently larger workload requires that parallel access controllers be recognized as a new class of lighting memory controller, rather than a mere modification of the traditional memory controller as optimized for cue-to-cue operation.

If this order-of-magnitude increase in workload is to be accomplished without a similar increase in cost and complexity, then the most efficient techniques must be employed for each of the controller's basic functions. While various lighting controllers have employed software, digital hardware, and analog designs for the various functions, maximum efficiency demands that each of the five functions be performed in the domain offering the most elegant solution to providing the necessary throughput.

An analysis of the operation of prior art controllers reveals that the primary bar to higher throughputs is the number of machine cycles required to perform the mastering multiplications. Part of the total is required for the multiplication itself. The balance is required for "housekeeping" operations: fetching the memory address at which the desired channel value is stored; fetching the channel value; fetching the preset master value; and, of course, returning to the operating program as stored in EPROM after each instruction to determine the next one. Depending upon the processor and the particular algorithm employed, the relative proportion of machine cycles devoted to each task will differ. The parallel access memory controller of the present invention is therefore based on the principle that throughput can be increased by removing the mastering function from the processor and particularly on the principle that the mastering operation and the transfer of data within the system be hardware rather than software driven.

Although it will be apparent that these principles could be employed to produce a system in which channel intensity data is transferred directly from a memory to a hardware multiplier without the intervention of a processor, it will be shown that certain special advantages attend the transfer of mastering multiplication and the comparison function—in contradiction of both current practice and current trends—from the digital to the analog domain.

The use of a plurality of hardware multipliers as the mastering means allows the use of either serial or parallel hardware comparators. The use of a serial/parallel conversion means between the memory means and the comparator means to allow the use of inexpensive diodes as the comparator means is illustrated.

The benefits of distributing channel intensity data to the mastering multipliers at least partly in digital form are described, as are the benefits of providing a short term storage means between the serial/parallel conversion and the mastering multipliers in order to allow the serial/parallel conversion for one channel and the mastering and comparison operations for another to take place simultaneously.

The design of a simple circuit providing mastering multiplication, comparison, serial/parallel conversion, and short-term storage as employed in the current embodiment of the parallel access memory system of the present invention is illustrated, a plurality of said circuits handling 147,000 mastering and comparison routines per second, a level determination workload 30 times greater than a typical traditional memory console disclosed.

Additionally, the benefits of employing a storedprogram processor for the control of operator interface and the use of Direct Memory Access as a method of maximizing efficiency when a low-power processor is employed for this purpose are discussed.

DETAILED DESCRIPTION

Figure 2A:
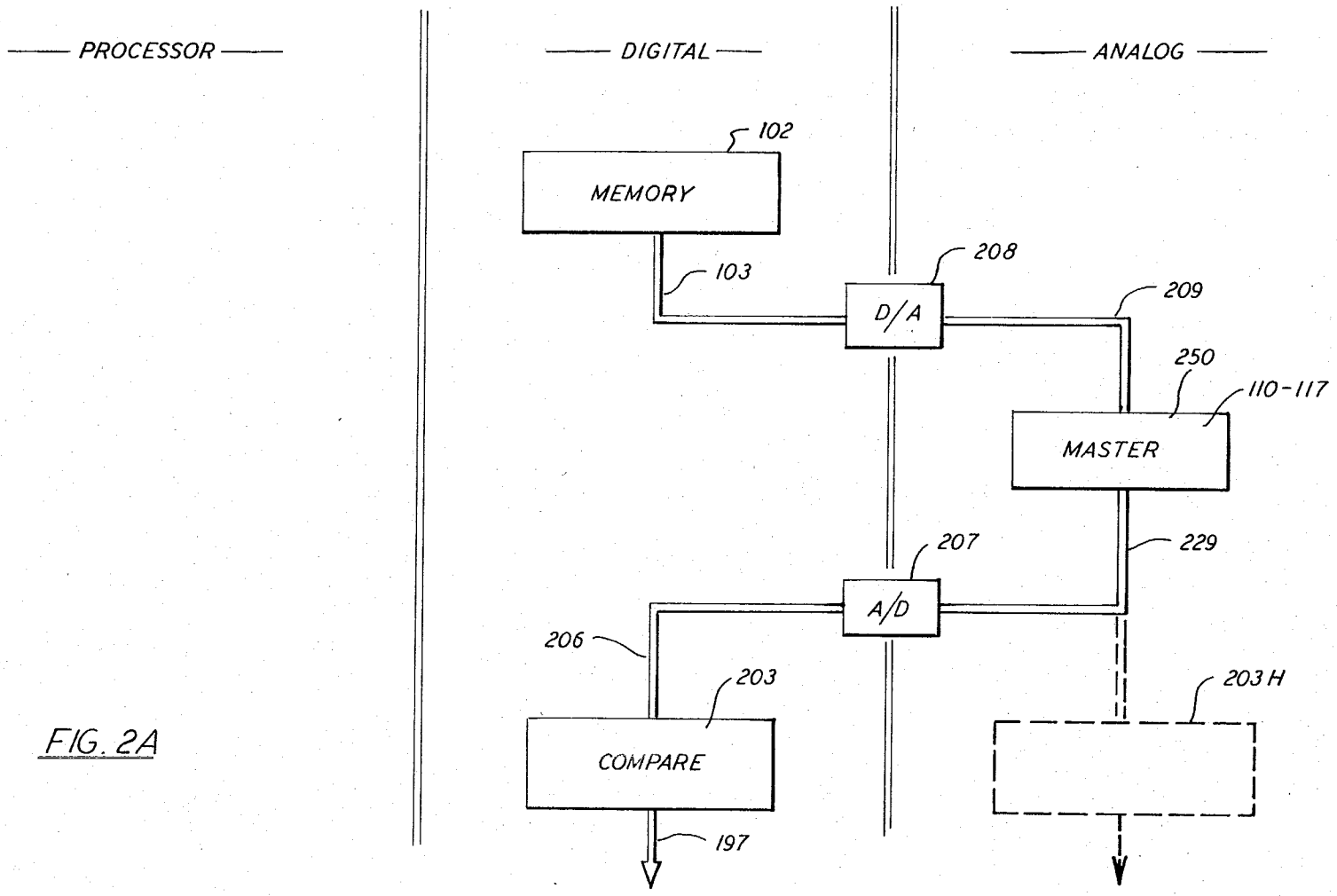
FIG. 2A is a representation of the distribution of the basic operations of the first embodiment of a parallel access controller employing analog hardware multiplication.
Figure 2B:
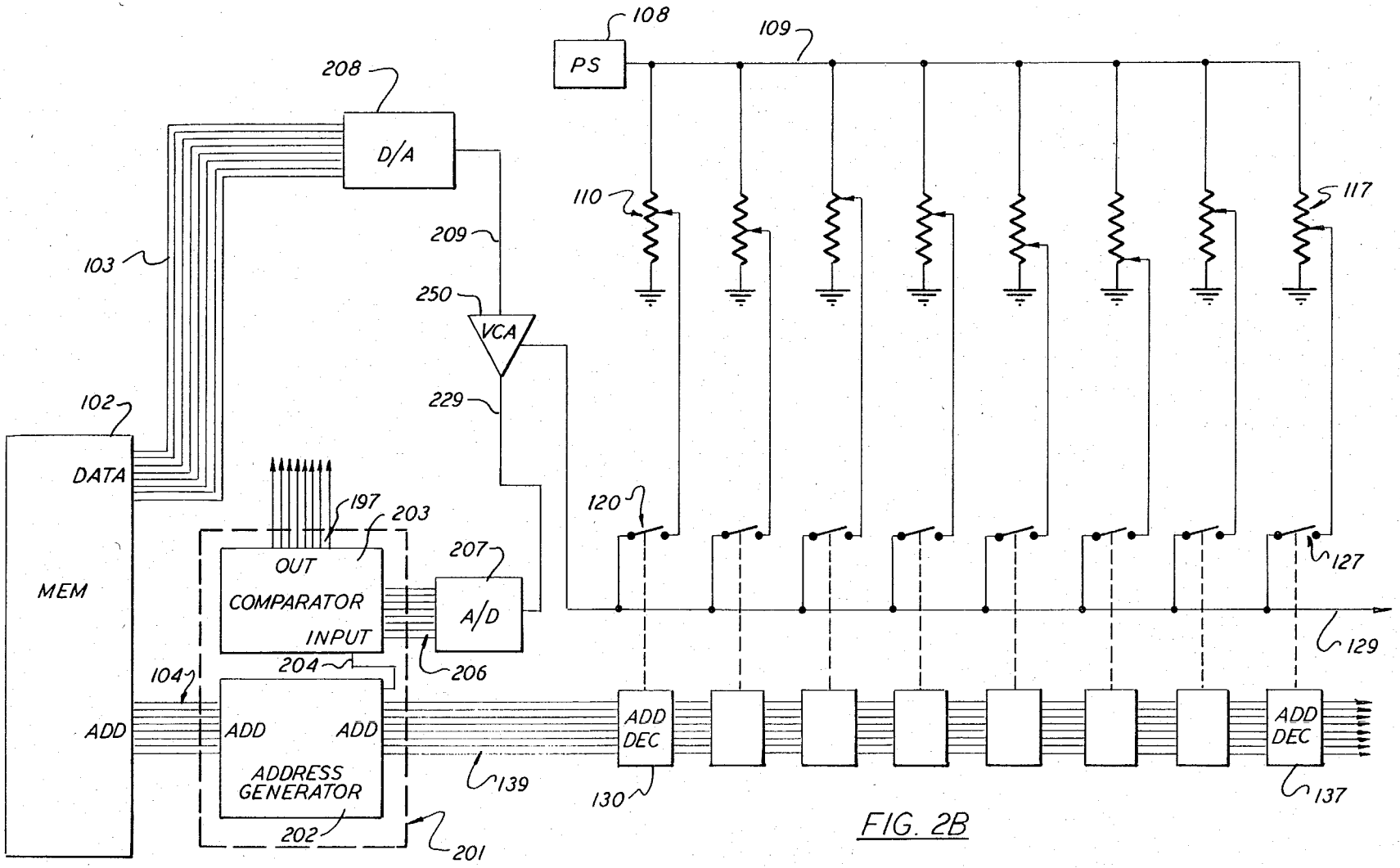
FIG. 2B is a block diagram of a typical hardware design showing a single analog multiplying means.
Figure 2C:
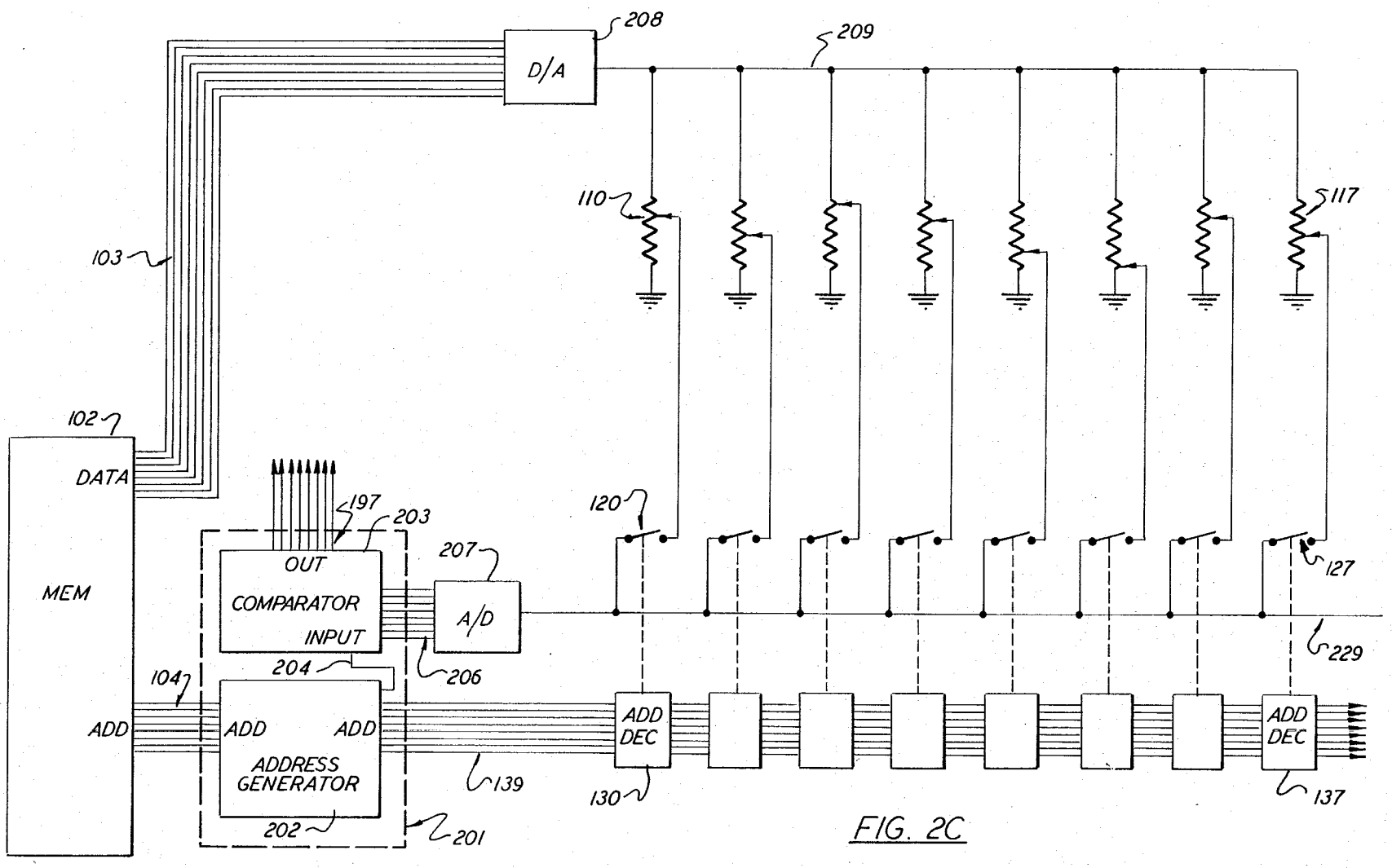
FIG. 2C is a block diagram showing a typical hardware design showing a plurality of analog multiplying means.

Refer now to FIGS. 2A, 2B, and 2C where a first embodiment of a parallel access memory controller with hardware driven memory access and analog multiplication according to the present invention are illustrated. FIG. 2A is a functional diagram showing the sequence of operations and their distribution between digital and analog hardware. FIG. 2B is a block diagram of typical hardware showing the use of a single analog multiplier. FIG. 2C is a block diagram showing the use of a plurality of analog multiplying means, specifically the preset master linear potentiometers. Parts with similar functions in other figures are identified with their reference numbers in those figures.

Refer now to FIG. 2B. Channel intensity data is stored in semiconductor memory 102 in digitally-coded form. During each channel interval, address generator 202 produces a series of addresses on bus 104 corresponding to the locations in memory 102 at which the desired value for that channel is stored for each of the available presets controlled via preset master potentiometers 110–117 (only eight of which are illustrated here for reasons of space). As each such address is produced during the preset [sub]interval of the channel subinterval, address generator 202 simultaneously produces an address on bus 139 corresponding to the appropriate preset master, and a means responsive to that address (illustrated here as a plurality of address decoders 130–137) closing an analog switch 120–127 for the appropriate preset master, coupling the attenuated DC voltage from power supply 108 to an output bus 129 in the manner described in connection with FIG. 1B. Unlike FIG. 1B, however, the value corresponding to the condition of the preset masters is coupled to the input of an analog multiplier 250 which is series-connected between D/A converter 208 and A/D converter 207.

The operation of the system is as follows: During each preset subinterval, address generator 202 causes memory 102 to output, in digital form, the desired intensity value for the channel in that preset. The channel value is coupled to the input of D/A converter 208 by bus 103 and the converter's output, which represents the channel value in analog form, is connected via line 209 to one input of analog multiplier 250, which in the example is a voltage controlled amplifier (VCA). Simultaneously, the sampling system associated with preset masters 110–117 couples a second analog value corresponding to the desired level of the appropriate preset's master via bus 129 to the second input of analog multiplier 250 which, operating upon the two values, produces an output on line 229 which represents the channel value as mastered.

FIG. 2B illustrates the comparison operation taking place in the digital domain. A/D converter 207 produces a digitized channel value, which is provided to the input of a hardware serial comparator 203 via bus 206. This serial comparator need comprise only two registers and a hardware comparator. Both the first register's input and the "A" input to the hardware comparator are connected to bus 206. Both the "B" input to the hardware comparator and the input to the second register are connected to the output of the first register. The "A" output of the hardware comparator is connected to the clock input of the first register; neither the "equals" nor the "B" outputs of the hardware comparator are connected. Therefore if the digitized level received from the A/D converter 207 is higher than the value currently held in the first register, the hardware comparator's "A" output will go high, causing the register to adopt the new value. If the new value is equal to or lower than the previous value maintained in the first register, either the hardware comparator's "equal" or "B" output will go high. As they are not connected to the first register's clock input, the register will retain the previous, higher value. After the last preset subinterval, the number remaining in the first register will therefore represent the highest level as mastered for the channel in any of the available presets. Address generator 202 may then produce an output on line 204, which is connected to the clock input of the second register, whose input is connected to the output of the first register and whose output is bus 197, the memory controller's output. The second register will thereupon adopt the value in the first register, representing the channel output, which will remain valid until the end of the next channel interval. Clearly, a D/A converter could be provided on output 197 if an analog output is preferred.

The address generation and comparison functions performed by the hardware devices within block 201 could be performed in whole or in part by a processor. But it will be seen that the parallel access memory system illustrated in FIG. 2B will perform the functions of the traditional memory system illustrated in FIG. 1B without the use of a processor. No digital multiplications are required and, just as importantly, no time-consuming consultation of a stored program is required for either the transfer of channel values from memory or the mastering or comparison functions.

It is, of course, possible to perform the analog multiplication with devices other than the voltage-controlled amplifier 250 illustrated in FIG. 2B. For example, a multiplying D/A converter could replace both analog multiplier 250 and D/A converter 208. Or the condition of master value bus 129 could be digitized in a manner similar to that employed in FIG. 1B and its output coupled to a digitally-controlled attenuator replacing voltage controlled amplifier 250.

It is also possible to perform the comparison operation in the analog domain using a comparison technique similar in principle to the digital technique illustrated.

The benefits of the parallel access system illustrated in FIG. 2B derive from the transfer of functions traditionally accomplished in a processor under the control of a stored program into hardware (and, in the case of the mastering function, into the analog domain). While the use of analog mastering has certain intrinsic benefits in this application, analog components require special care when operating at high frequencies. As indicated by the bolder lines in FIG. 2A, all the components of the system must operate at the preset subinterval rate (which, in the case of a memory system providing access to 48 presets of 120 channels with a 15 Hz. refresh rate, is 86,400 samples per second.) Further, because the analog data is in stepped transition form, reasonable accuracy generally requires a system capable of passing sine waves at a frequency five or ten times higher.

As such, the analog portions of the device must be capable of passing almost one Megahertz signals.

One important improvement to the system illustrated in FIG. 2B may be effected by the replacement of the active analog multiplier 250 with a passive device capable of high frequency operation. It is frequently overlooked that the inexpensive linear potentiometers employed for preset master faders in all lighting control products are capable of operation as analog multipliers at frequencies as high as low video rates. Accordingly, FIG. 2C illustrates an improved system in which the preset master potentiometers 110–117 serve as the analog multipliers. Specifically, the output of the D/A converter 208 producing the analog value corresponding to the desired channel intensity value is distributed to the input side of the preset master potentiometers 110–117 by bus 209. In the manner described in connection with FIG. 2B, the sampling system connects the output of the appropriate preset master to bus 229 during the same preset subinterval that its desired channel value is provided to D/A converter 208 by the memory 102. Accordingly, bus 229 carries the channel value as mastered which may be connected to a serial comparison means, which may be either analog or digital in design (a digital comparator 203 being illustrated.)

The analog multiplying method disclosed in FIG. 2C offers a lower hardware cost than that illustrated in FIG. 2B, and eliminates concern for the ability of the analog multiplying means to operate at the frequencies required.

While the parallel access subsystem of FIG. 2C illustrates the increase in throughput possible with hardware driven memory access and analog multiplication, and while it illustrates an elegant solution to the problem of an analog multiplier capable of sufficient rates, the balance of the analog portion of the system must still operate at the higher rate. FIGS. 3A, 3B, 4A, and 4B therefore illustrate methods by which the operating frequency of the balance of the analog portion of the memory controller may be reduced from the preset subinterval rate to the channel interval rate, i.e. by a factor of as much as 48:1.

Figure 3A:
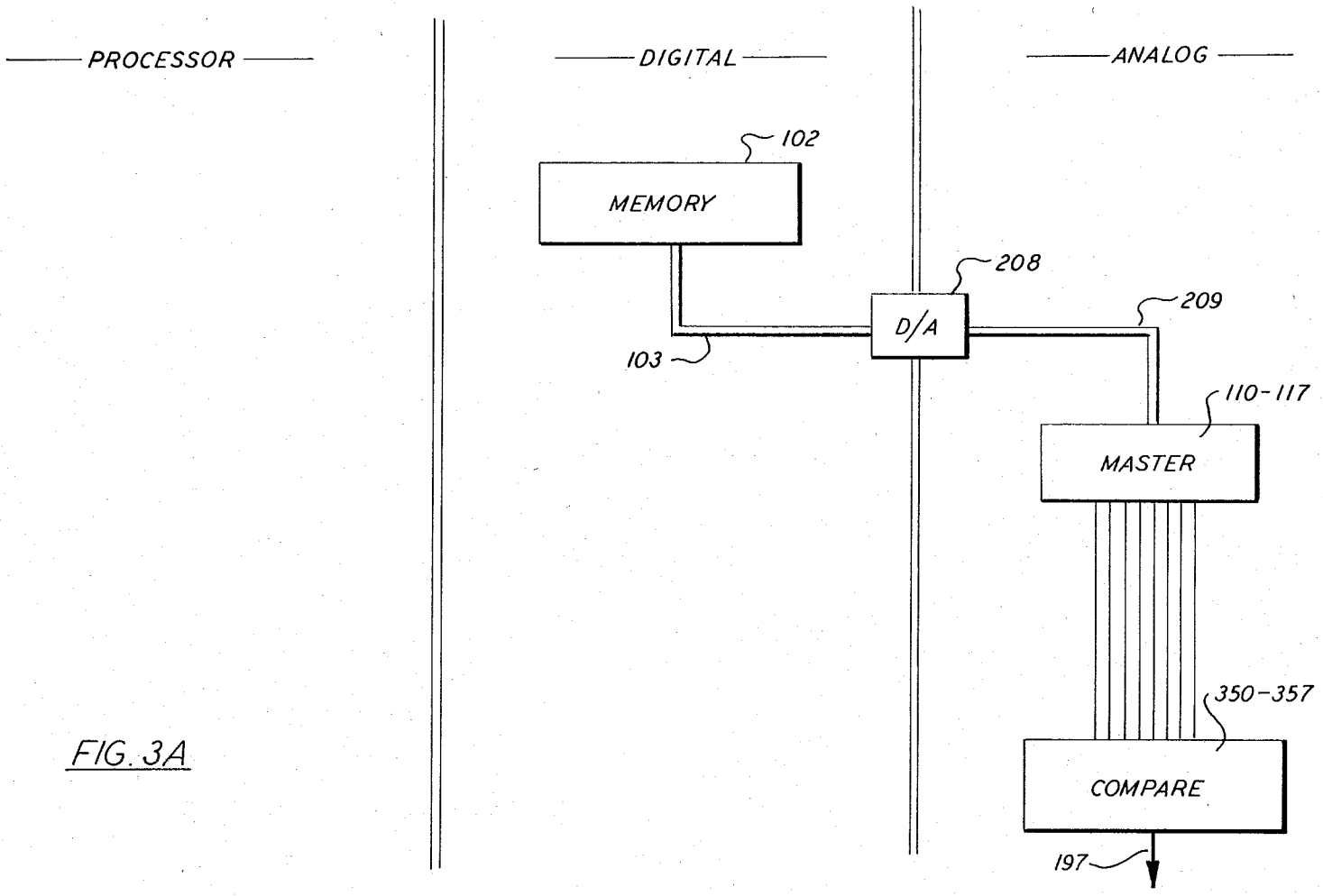
FIG. 3A is a representation of the distribution of the basic operations of a parallel access controller employing analog parallel comparison.
Figure 3B:
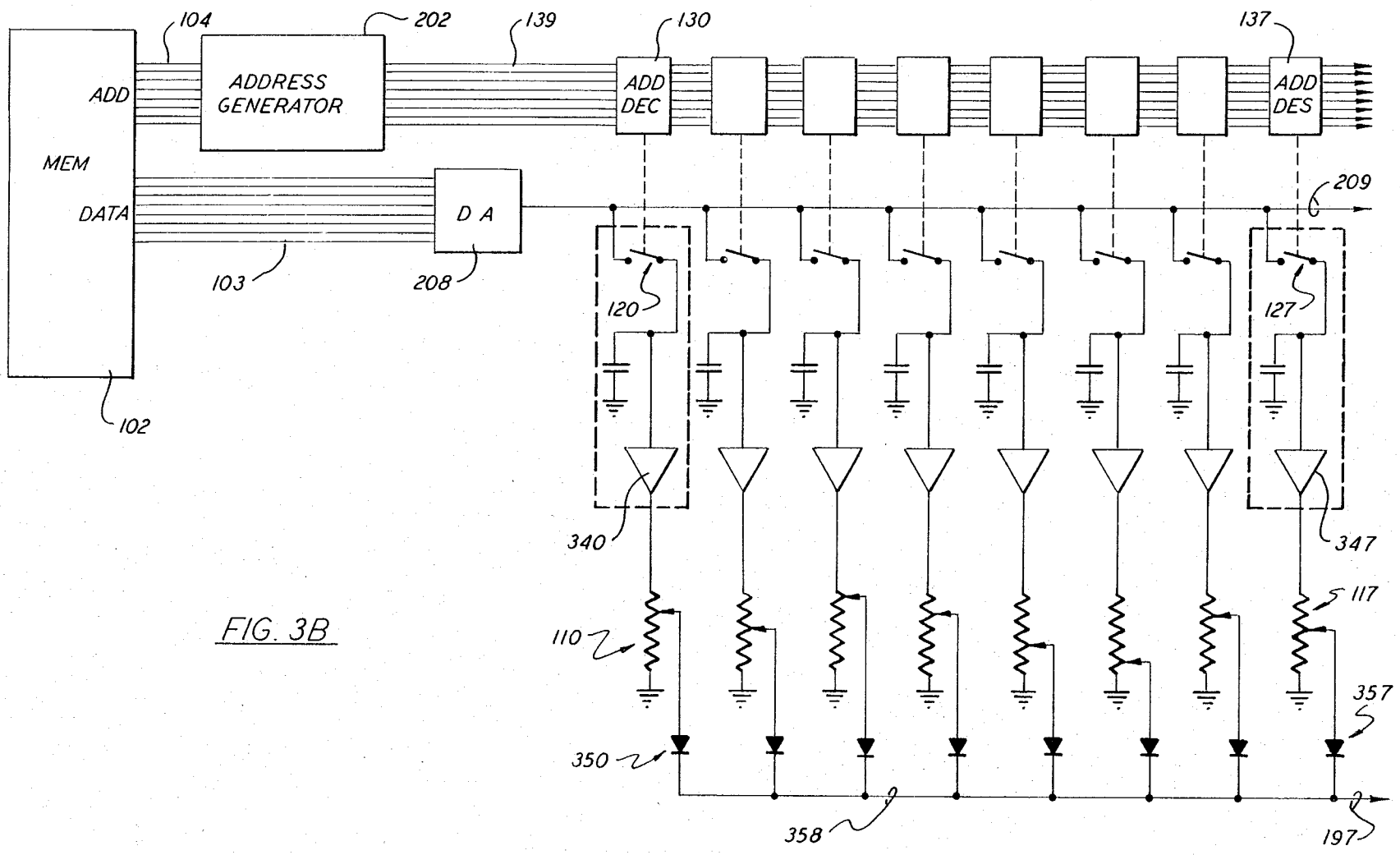
FIG. 3B is a block diagram of a typical hardware design showing analog parallel comparison.

Refer now to FIGS.- 3A and 3B where a method of providing the comparison function in the analog domain at lower rates is illustrated. FIG. 3A is a functional representation of the system's operation. FIG. 3B is a block diagram of a typical hardware design. Parts with a similar function to those in other figures are identified with the same reference numbers.

Like the system of FIGS. 2B and 2C, a memory 102 operating under the control of an address generator 202 provides the desired channel intensity value to D/A converter 208 via bus 103 for each preset in that preset's subinterval of the channel interval. Simultaneously, the system closes the analog switch 120–127 for the appropriate preset master potentiometer 110–117. Like the system illustrated in FIG. 2C, the output of D/A converter 208 is distributed to the input side of the preset master potentiometers by bus 209 so that the appropriate preset master potentiometer will be series-connected between the converter 208 and the combining means, producing the channel value as mastered.

FIG. 3B, however, illustrates means to carry out a serial/parallel conversion of the analog channel value, shown here as sample and hold circuits 340–347, such that the channel values as mastered are available simultaneously and in parallel, allowing the use of inexpensive combining diodes 350–357 as the comparison means. As illustrated, the sample and hold circuits 340–347 preceed the preset master potentiometers 110–117, such that they maintain the channel levels. However, it will be apparent that the sample and hold circuits could be placed after the preset master potentiometers as well, where they would maintain the channel level as mastered.

The insertion of a serial/parallel conversion into the series connection between D/A converter 208 and the output 197 allows the use of a simple comparator (in the form of combining diodes) which need operate at a far lower rate than the serial comparator 203 illustrated in FIG. 2B. However, as illustrated by the bold line 209 in FIG. 3A, the D/A converter 208 and particularly the analog value distribution bus 209 connecting its output with the mastering means are still required to operate at the higher, preset subinterval rate.

Figure 4A:
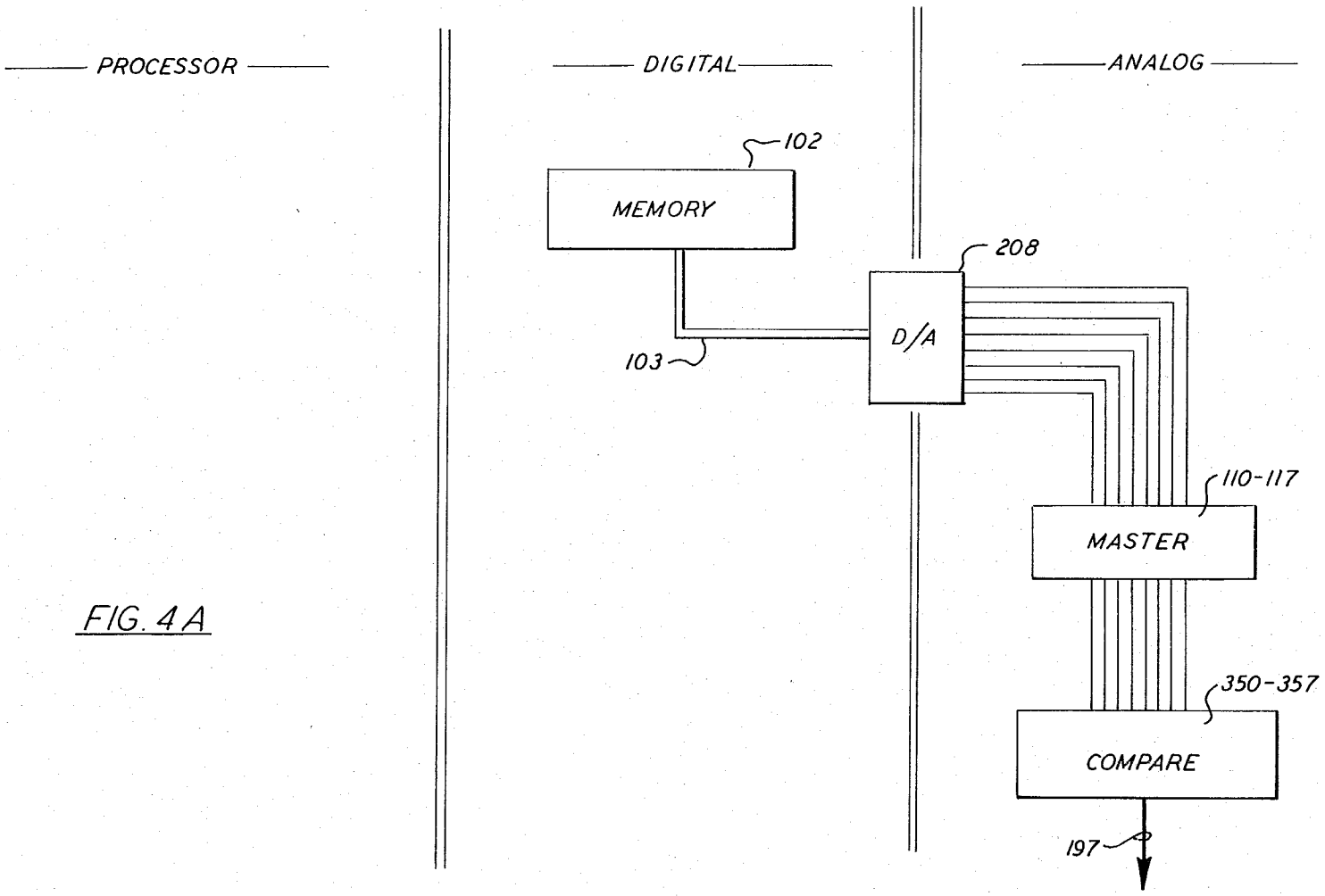
FIG. 4A is a representation of the distribution of the basic operations of a parallel access controller employing distribution of the channel intensity value while still in digital form.
Figure 4B:
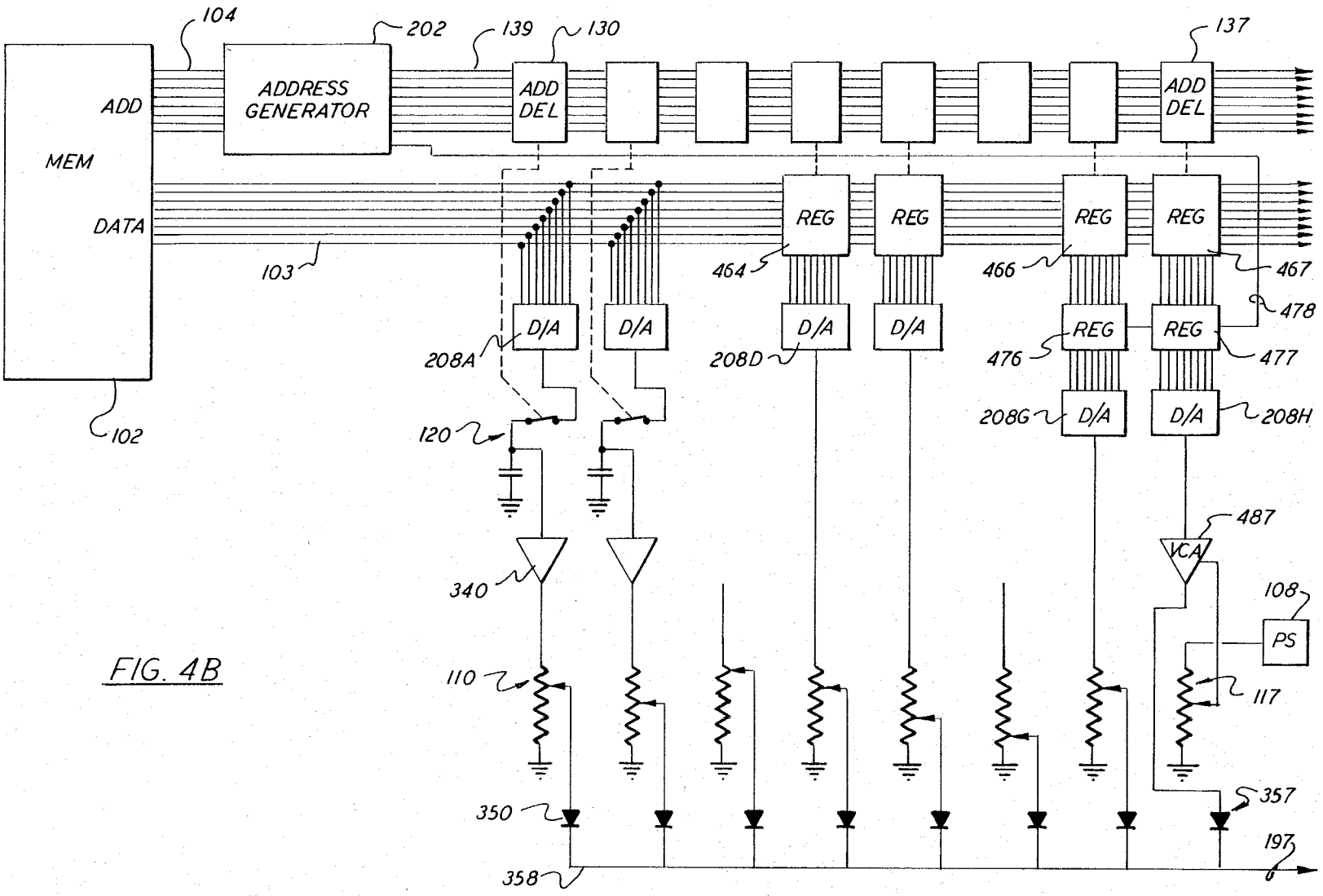
FIG. 4B is a block diagram of a typical hardware system showing digital intensity valve data distribution.

Refer now to FIGS. 4A and 4B where a parallel access system, no analog portion of which is required to operate at high frequencies is illustrated. FIG. 4A is a functional representation of the system's operation. FIG. 4B is a block diagram of typical hardware designs showing several different approaches to certain functions. Parts with functions similar to those in other figures are identified with the same reference number.

The Operation of the system in FIG. 4B is distinguished from that in FIG. 3B in that a plurality of A/D converters 208A–208H have been distributed to the preset mastering means such that the channel intensity value of memory 102 is distributed to the digital/analog converters via a digital bus 103. Such a technique makes use of the fact that digital buses are intrinsically capable of higher data rates than analog buses. The distribution of channel values in digital form also allows the use of registers 464–467 for the serial/parallel conversion rather than using sample and hold circuits 340, eliminating the concern for accuracy required by the use of such analog devices.

FIG. 4B also illustrates an additional method of increasing throughput. It will be recognized that the addition of the serial/parallel conversion first illustrated in FIG. 3B requires that most of the channel interval be devoted to the distribution of channel values to the serial/parallel conversion means. Only after the last preset subinterval of the channel interval does the output of the comparing means become valid. To the preset subintervals must therefore be added the time required for a valid sample of the output.

The parallel access memory controller illustrated in FIG. 4B therefore illustrates the addition of a second short-term memory between the serial/parallel conversion means and the mastering means, illustrated here as registers 476 and 477.

Address generator 202 operates with a one channel offset between its output to memory 102 on bus 104 and the channel on which mastering means 110–118 and 487 are operating. During the channel interval for channel #10, for example, address generator 202 will cause memory 102 to output the desired intensity values for channel #11, which will be maintained by the short-term memory associated with the serial/parallel conversion (whether analog sample and hold 340 or digital registers 464–467). At the start of the channel interval for channel #11, address generator 202 will produce an output on bus 477 which, connected with the clock input of the second registers (476 being typical) will load the required channel values from the serial/parallel conversion means. The mastering and comparison means therefore have valid data very early in the channel interval and may operate on it immediately. Simultaneously, the address generator will distribute the values for channel #12 to the short-term memory associated with the serial/parallel conversion. The result of this overlapping of the two functions is a significant improvement in throughput.

Another benefit of the decrease in operating frequency in the analog section is the ability to employ an active analog multiplier responsive to the linear potentiometer rather than the linear potentiometer itself as the mastering means, illustrated here as voltage controlled amplifier 487. The function of both D/A converter 208H and the analog multiplier 487 may be served by a multiplying D/A converter. A single integrated circuit is now available providing two registers and a multiplying D/A converter, allowing a single such package to serve for register 467, register 477, converter 208H, and analog multiplier 487.

It should, however, be specifically understood that although a single D/A converter is illustrated for each available preset, and this approach is employed in the present embodiment of the memory controller as produced, that a unit designed for larger volume production would employ a plurality of such converters at an intermediate level such that the connection between the memory 102 and the mastering means is part digital and part analog in nature. By interlacing the preset information such that, for example, the channel's values in the presets are distributed in a 1, 9, 17, 25, 33, 41, 2, 10, 18, 26, 34, 42, etc., order, eight preset subintervals would be allowed for the operation of the analog portions of the system, representing a reasonable compromise between economy and data rates.

It should be further understood that while the mastering multiplication illustrated in connection with earlier evolutions of the system as illustrated in the figures are analog, that the distribution of preset data in at least part digital form allows the use of multiplication techniques which are at least part digital. For example, the multiplying D/A converter described in connection with FIG. 4B is represented as a D/A converter followed by a voltage-controlled amplifier, although it could be represented with equal accuracy as a hardware multiplier with an A/D converter on one input, and in actual construction it represents something inbetween. The basic principle of the parallel access system of the present invention remains the distribution of digitally-encoded channel data from a memory means to a plurality of hardware mastering multipliers and comparators with limited processor intervention, if any.

Figure 4C:
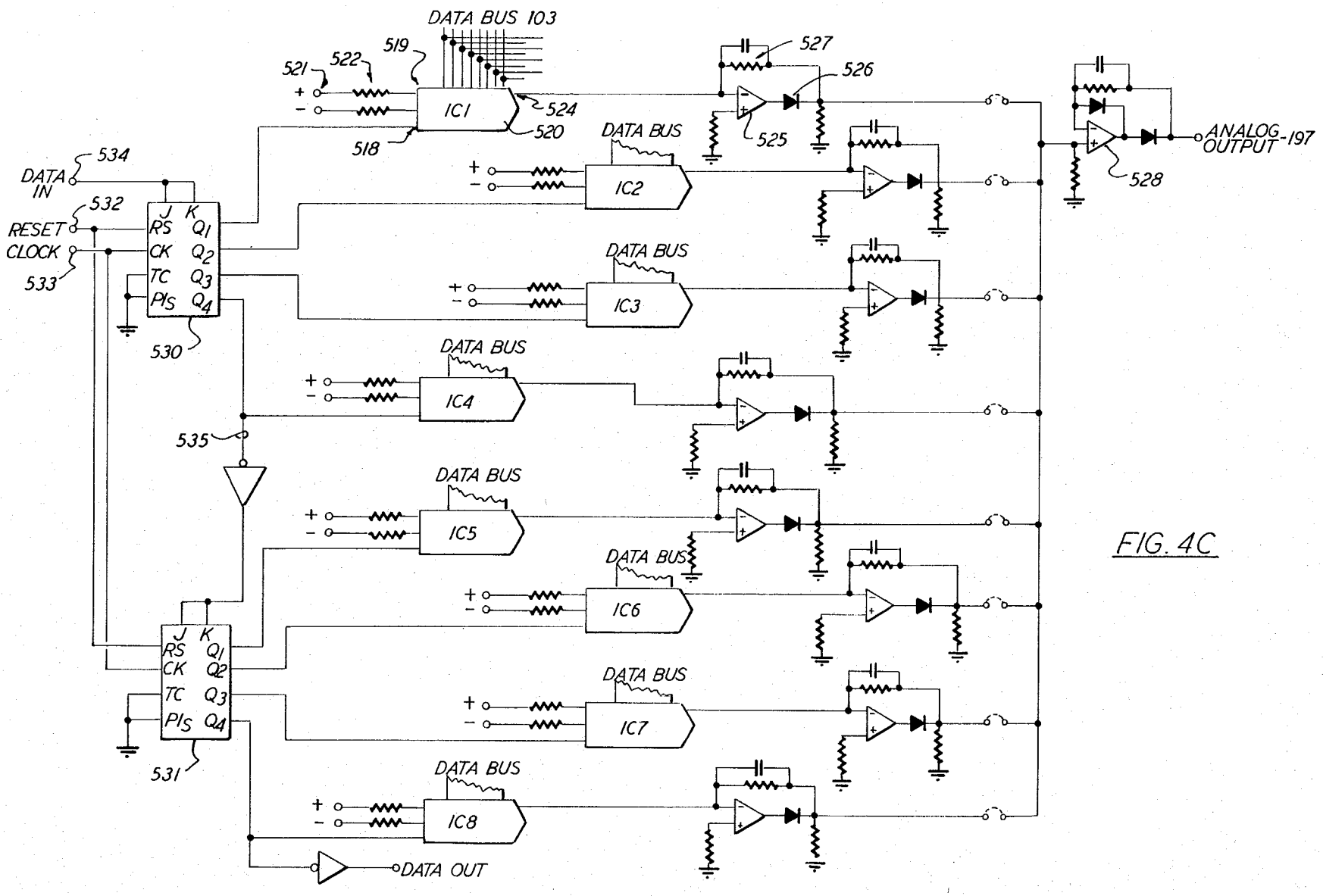
FIG. 4C is a schematic showing the mastering and comparison unit as currently manufactured.

Refer now to FIG. 4C, a schematic of the mastering and comparison circuit including its associated serial/-parallel conversion, short-term storage means, and address decoder as currently manufactured.

Each such mastering and comparison card contains the hardware necessary for eight presets. Access to larger numbers of presets is provided by simply paralleling multiple cards. Each such card contains eight DAC-808 packages (as manufactured by Precision Monolithics, Santa Clara, Calif.), each of which provides a multiplying D/A converter and two registers as previously described. Each such converter (520 being typical) is provided with one digital input 523 paralleled to channel intensity value buss 103, and one analog current input 519, accepting a 0–10 volt signal corresponding to the desired preset master level from the preset master linear potentiometer via input 521 which is converted from voltage to current by precision resistor 522. Each converter is also provided with a "Chip Enable" input 518 connected with the corresponding output of the address decoder, which comprises two 4-bit shift registers 530 and 531 per 8-preset card.

The address generation system produces two types of signal employed by the card's address decoder. A channel reset pulse is received, via line 532, and bussed to the Reset inputs of all shift registers. A preset pulse train is received via line 533 and bussed to the clock input of all shift registers.

In addition, a line 534 held permanently high is connected to the data input of the shift register controlling Preset #1's converter, while the remaining shift registers are cascaded, 535 representing a typical connection.

The channel reset pulse received via line 532 at the start of each channel interval clears all registers. Because the registers employed are of a type (CD4035) that internally inverts its outputs, the state of the outputs to the Chip Enable inputs 518 of all converters goes high. The address generator produces a number of preset clock pulses during each channel period equal to the number of presets, the first such pulse occuring after the channel intensity value for Preset #1 is loaded from memory means 102 onto buss 103. The arrival of the first preset clock pulse of the channel interval therefore causes shift register 530 to clock the high state of its input into the first register, causing its inverted output and as such the Chip Enable input 518 of converter 520 to go low. The internal logic of converter 520 causes a falling edge to latch the data present on its digital input 523 into its first register. As additional clock pulses are received by the shift registers on buss 533, each register will successively go high, causing the next converter to latch the corresponding channel value, which is presented in synchronization on bus 103. After the number of preset clock pulses equal to the number of presets, all channel values will have been loaded into the converters' first registers and the serial/parallel conversion will be complete. The channel reset pulse received by all registers via buss 532 at the start of the next channel interval will reset all the shift registers simultaneously, whose inverted outputs will go high. The internal logic of the converter transfers the channel value held in the first register to the second register on the leading edge of its Chip Enable input 518, causing the multiplying D/A converters for all presets to operate simultaneously on their respective channel intensity value as loaded from buss 103 and their respective preset master value as received at input 521, producing a current on output 524 representing the channel value as mastered.

As described in connection with FIG. 4B, the short-term storage means afforded by the converters' second registers allows the mastering and comparison operation for one channel and the serial/parallel conversion for the next to take place during the same channel interval. The current output 524 is converted to a voltage by a precision half-wave rectifier comprising amplifier 525, diode 526, and precision resistor 527. The outputs of the card's precision half-wave rectifiers are presented to the input of a non-inverting precision rectifier 528 which serves as a buffer to output 197.

Figure 1A:
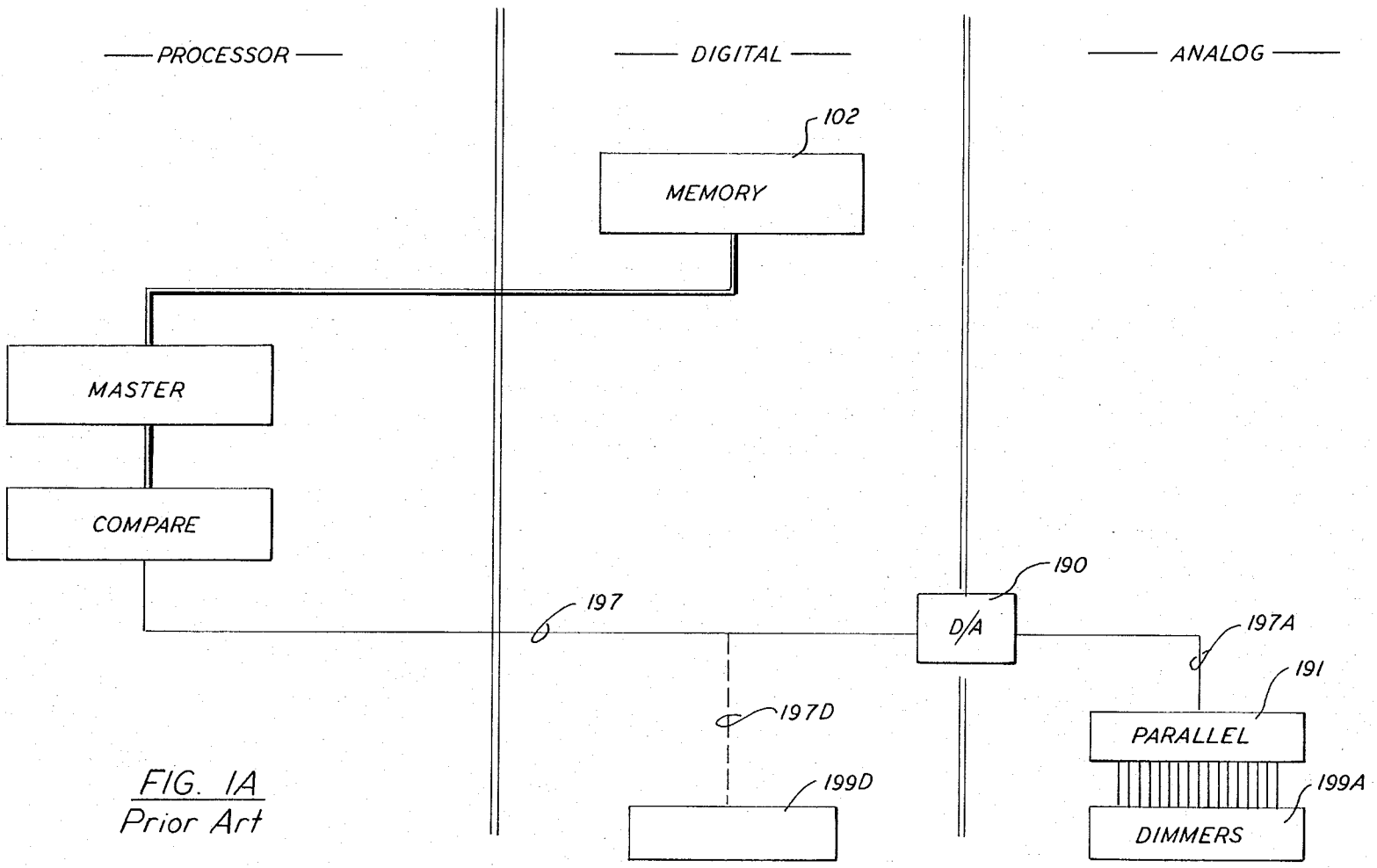
FIG. 1A Prior Art
FIG. 1A is a representation of the distribution of the basic operations of prior art memory systems based on the serial/computational approach between the processor, digital hardware, and analog hardware.
Figure 1B:
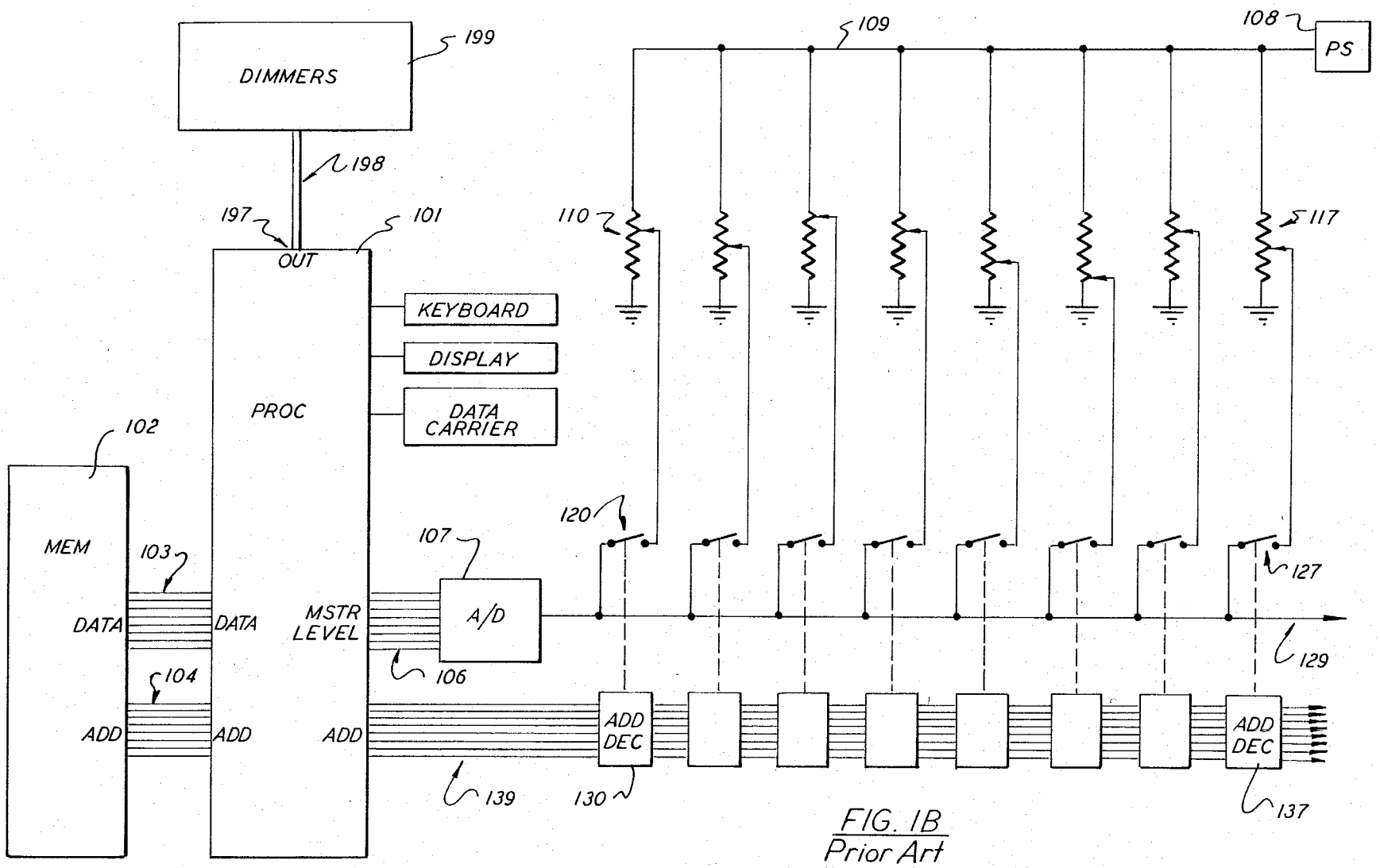
FIG. 1B Prior Art
FIG. 1B is a block diagram of a typical hardware design for a prior art memory controller based on the serial computational approach.

It should be noted that the benefits of the design principles employed by the parallel access memory system of the present invention are such that six of the cards illustrated in FIG. 4C provide 147,456 mastering and comparison operations per second; a workload 30 times higher than that required of the traditional memory console described in connection with FIGS. 1A and 1B; providing simultaneous access to a number of presets and channels at a refresh rate generally regarded as possible only with a highly complex parallel-processor system.

It will also be apparent that the simplicity and economy of the techniques illustrated in FIG. 4B allows the mastering and comparison section of the system to be employed with a variety of existing processor-based lighting controllers, adding parallel access capability to the cue-to-cue capability they already afford.

It will be apparent that the basic operation of the parallel access memory system illustrated in FIG. 4C, like those in the previous figures, does not require a processor (although one could be employed). There is, however, the need to enter level data into memory means 102; to display it for the operator; to transfer it to and from a data carrier; and, in copying presets, to transfer it between memory addresses. While all of these functions could be performed by hardware circuits, the parallel access system of the present invention recognizes that these functions can best be performed under the control of a stored-program processor. Accordingly, the parallel access system of the present invention employs a processor for the operator interface.

Because the processor and the mastering and comparison means share the same channel level memory means 102, a method of eliminating contention between the two is required. Tri-state drivers might be employed to alternately isolate the operator interface processor and the parallel access memory system itself from the address and data busses of the memory means. Some form of interrupt structure would also be required to non-destructively suspend any program running in the O/I processor requiring access to the memory means while control of the memory address buss is switched to the parallel access system.

These functions and others can be more elegantly accomplished by employing a processor providing Direct Memory Access.

Direct Memory Access represents a combination of features in the basic hardware design of a processor system whose purpose is to allow access to a common memory means by both the processor and an external, hardware-driven device, and to maximize data transfer rates in the hardware-controlled mode.

Typically, an external hardware device first causes a processor interrupt starting a short software routine loading the starting address of the first block desired in the memory means into a hardware "DMA Register".

Once this initializing operation is complete, the external hardware driver is signalled that DMA may begin, and it raises a "DMA Request" input line to the processor. When this line goes high, the processor non-destructively suspends any program running and relinquishes control of the memory address bus to the DMA Register, causing the memory means to output the first byte of desired data. The DMA control hardware also provides for a DMA clock input, and each clock pulse causes the DMA Register to increment by one, causing the memory means to output the next byte of data. Each machine cycle therefore results in a data output with no time-consuming intermediate operations required. Some processors providing DMA also supply much of the necessary hardware as well as the means to non-destructively suspend processor operation and relinquish control of the memory address buss. Further, unlike non-DMA processors, the DMA interrupt does not require valuable processor time be devoted to storing the current condition of the running program and any data currently being operated on before the interrupt; or recovering it from storage and reproducing the condition of the program at interruption when the interrupt is complete. The use of a processor providing DMA as the operator interface processor for the parallel access memory system of the present invention not only resolves the bus contention problem, but assures that the useful processor time available between DMA interrupts is maximized. Further, because the processor has little or no role in the determination of channel levels, which has heretofore represented the primary purpose of and workload on the processor, a single-processor parallel access system of the present invention makes a heretofore unprecedented amount of processor power available for sophisticated operator interface and data manipulation features.

It should, however, be specifically understood that although the benefits of both hardware-driven transfer of level data and the use of DMA have been described, they represent solutions to specific embodiments of the parallel access system employing processors of low power. Were the system to employ a processor of higher power, a tight software loop could be written which allows software-driven transfer of level data, and the time required for this type of transfer would not represent a major impediment to sufficient system throughput. Minimizing the amount of time required for the transfer would suggest the use of the same block organization of preset data employed in the present embodiment of the system rather than the active memory schemes employed by many traditional consoles, which uses techniques like linked lists to maximize the preset capacity of the memory means.

Figure 5:
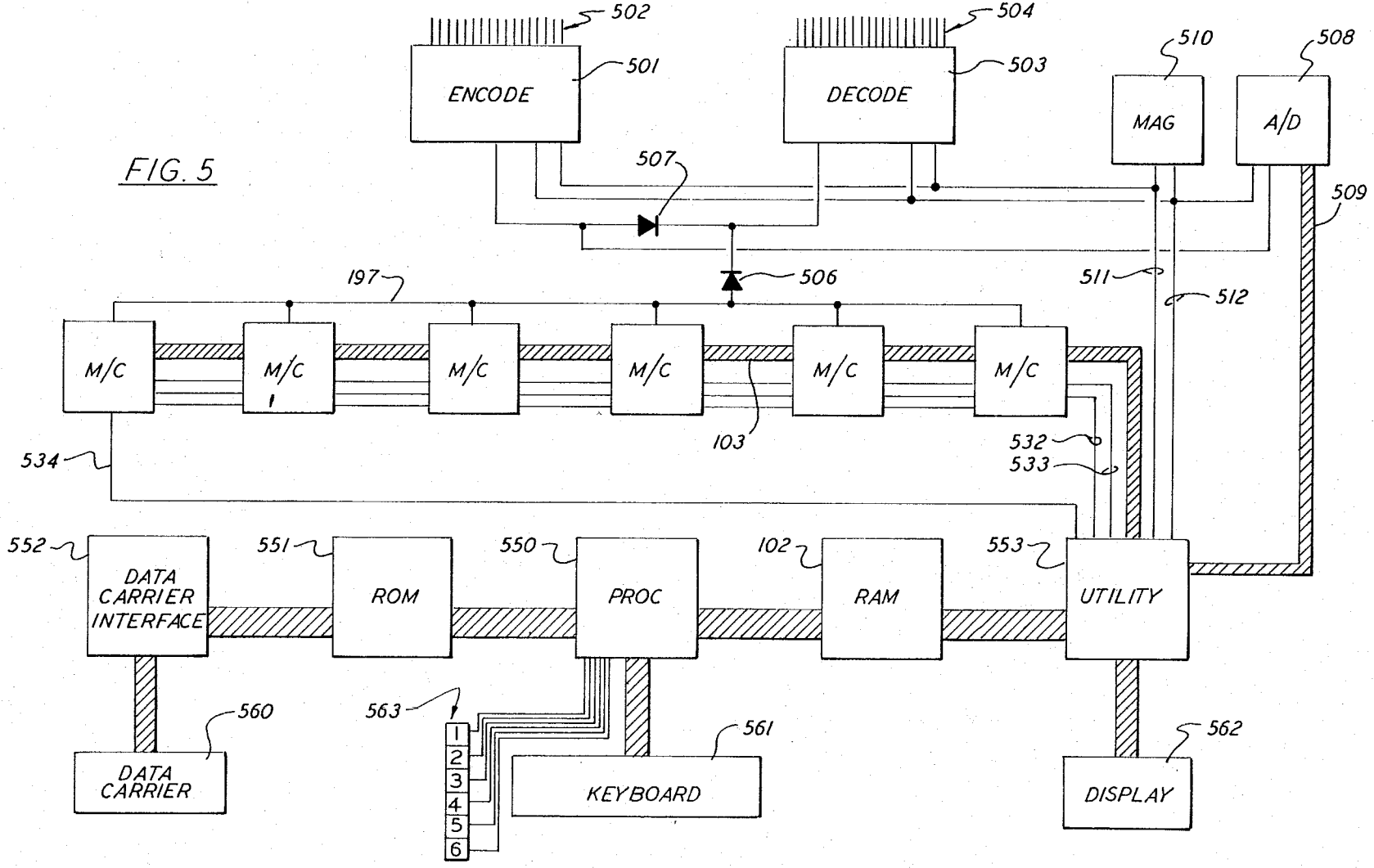
FIG. 5 is a block diagram of the total parallel access memory controller as currently manufactured.

Refer now to FIG. 5, which is a block diagram of the total parallel access system of the present invention as currently in use by a major national concert tour.

Components in the top row are associated with conversion from and to 0–10 volt outputs and inputs of the manual console and dimmers employed (Multiplexed Snake TM components as manufactured by The Console Works, New York, N.Y.).

Components in the second row are the mastering and comparison cards illustrated in FIG. 4C.

Components in the third row are associated with both the parallel access system and the operator interface processor: Processor card 550, a ROM/EPROM card 551 for stored programs, and a 32K RAM card 102 serving as the system's memory means. All three are RCA Microboards (CDP18S601, CDP18S652, and CDP18S626 respectively) as produced by RCA Solid State, Somerville, N.J. A Data Carrier Interface Card 552 is provided as required by the data carrier selected, and a Utility Card 553 mounts any miscellanious hardware required by the system.

Components in the fourth row are the actual operator interface devices including the Data Carrier 560 (Model CM600C as produced by Braemar Devices, Burnsville, Minn.); a Keyboard 561 (Mode1 26SD1-2 as produced by Microswitch, Freeport, Ill.); an alphanumeric Display 562 (Model DEC 220 as produced by Digital Electronics Corporation, Haywood, Calif.); and a Page Select Switch Bank (a multi-position, mechanically-interlocked switch bank allowing the operator to "page" the preset masters so that the 48 preset master faders provided may access a total of 240 presets).

Decoder 503 is provided to convert the system output 197 from its serial form to parallel outputs 504 compatable with conventional analog dimmers.

Encoder 501 is provided to convert the analog parallel input 502 of the 2-scene manual console used as one of the channel level entry means to a compatable analog serial signal, which may be digitized by A/D converter 508 for connection to the parallel access system via 509 so that the output of the manual scenes may be recorded directly into memory means 102 as a preset. The output of encoder 501 is also combined with the parallel access system output 197 by diodes 506 and 507 so that the input presented to decoder 503 constitutes the summed outputs of both manual and memory presets.

The analog switches of encoder 501 and the sample and holds of decoder 503 are synchronized with each other by Multiplex Address Generator 510 which also serves as the master address generator for the parallel access memory system.

The Multiplexer Address Generator 510 is a simple hardware device producing two primary outputs: a channel clock pulse train at 3120 Hz. and a system reset pulse two channel clock periods in length at the start of a refresh cycle. These outputs are connected by busses 511 and 512 to the various system components. The channel clock pulse, after conditioning on the Utility Card 553, also serves as the channel reset pulse, which is connected to the mastering and comparison cards by line 532. Each channel interval is subdivided into the correct number of preset subintervals by the combination of a higher frequency pulse train produced by Processor Card 550 and a programmable counter on Utility Card 553 which is strapped with the number of presets.

The operation of the operator interface processor with the keyboard, display, and data carrier are well understood by those skilled in the art.

It should be specifically understood that the designs illustrated in FIGS. 4C and 5 represent only one of the possible embodiments of the parallel access system of the present invention, and that a heretofore unprecedented combination of performance and features is achieved by the system of the present invention relative to prior art systems of equivalent or greater cost and complexity.

What is claimed is:

1. In a lighting control console for providing control outputs to dimmers for each of a plurality of channels, said console including a digital memory for storing intensity valves for each of said channels for each of a plurality of presets and means for preset mastering of intensity values by multiplying the channel intensity valves for each preset by a master value for that preset, and means for selecting the highest mastered intensity for each channel and providing it as the control output for that channel, the improvement comprising:

(a) a plurality of preset faders, one for each available preset, each providing an output proportional to the mechanical setting of said fader;

(b) the preset mastering means comprising a plurality of hardware multipliers (c) means for transferring channel intensity values to said multipliers including:

i. a bus coupled to said memory;

ii. means to provide said channel intensity values for a given channel in the available presets as serial outputs to said bus from said memory; and iii. means for distributing said serial outputs to said multipliers;

(d) means for comparing the outputs of all of said multipliers and providing the highest as the channel output;

(e) means, between said memory and said comparators, for converting digital outputs from said memory to analog form; and (f) means for insuring that the outputs of all said multipliers are maintained at the input of said comparator for a time sufficient to perform a comparison.

2. Apparatus according to claim 1, wherein said hardware multipliers comprise analog hardware multipliers.

3. Apparatus according to claim 1, wherein said preset faders comprise linear potentiometers.

4. Apparatus according to claim 3 wherein said linear potentiometers also act as said hardware multipliers.

5. Apparatus according to claim 1, wherein said hardware multipliers comprise digital hardware multipliers.

6. Apparatus according to claim 1, comprising a multiplying digital to analog converter acting both as said mastering means and said means for converting.

7. Apparatus according to claim 1, comprising one digital to analog converter for each preset master fader acting as both mastering means and means for converting.

8. Apparatus according to claim 1, wherein said means for converting comprise a plurality of digital to analog converters.

9. Apparatus according to claim 1, and further including means for storing the distributed serial outputs.

10. Apparatus according to claim 1, and further including means for transferring desired channel intensity values to said memory.

11. Appartatus according to claim 1, wherein said means for transferring comprise a stored-program processor.

12. Apparatus according to claim 10, wherein said means for transferring comprise a stored-program processor having direct memory access.

13. Apparatus according to claim 1, wherein said means for transferring comprise a keyboard.

14. Apparatus according to claim 1, wherein said means for transferring comprises a lighting controller providing at least a first potentiometer for each of a plurality of channels.

15. Apparatus according to claim 1, and further including means to display intensity values of channels as stored in said memory.

16. Apparatus according to claim 1, and further including means to transfer channel intensity values to and from a data carrier.

17. Apparatus according to claim 1, and further including means to couple said preset master faders to multiple groups of presets.

* * * * *